US007078611B2

(12) United States Patent
Izumi et al.

(10) Patent No.: US 7,078,611 B2
(45) Date of Patent: Jul. 18, 2006

(54) KEYBOARD INSTRUMENT

(75) Inventors: Ryuichi Izumi, Hamamatsu (JP); Kei Kunisada, Hamamatsu (JP); Takashi Fujita, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 11/036,684

(22) Filed: Jan. 14, 2005

(65) Prior Publication Data

US 2005/0150368 A1 Jul. 14, 2005

(30) Foreign Application Priority Data

Jan. 14, 2004 (JP) ..... 2004-007403
Jan. 16, 2004 (JP) ..... 2004-008969

(51) Int. Cl.
*G10H 1/32* (2006.01)
*G10H 3/00* (2006.01)

(52) U.S. Cl. ..... 84/743; 84/177; 84/DIG. 17

(58) Field of Classification Search ..... 84/177, 84/179, 743, DIG. 17
See application file for complete search history.

(56) References Cited

U.S. PATENT DOCUMENTS 4,635,521 A * 1/1987 Bellini ..... 84/177
5,031,500 A 7/1991 Koike et al.
5,086,686 A 2/1992 Misawa et al.
5,248,846 A 9/1993 Koike et al.
6,828,497 B1 * 12/2004 Yataka et al. ..... 84/625
6,916,980 B1 * 7/2005 Ishida et al. ..... 84/743
2003/0051594 A1 * 3/2003 Ishihara et al. ..... 84/177

FOREIGN PATENT DOCUMENTS

JP 2720459 B2 11/1997
JP 2002-244661 A 2/2001
JP 2002-297141 A 10/2002

* cited by examiner

*Primary Examiner*—Jeffrey W Donels

(74) *Attorney, Agent, or Firm*—Morrison & Foerster LLP

(57) ABSTRACT

An instrument main body has a keyboard including a plurality of keys and sound generators (for example, speakers) at a rear of the keyboard. At the rear of the keyboard, an upper surface cover portion composed of an upper panel, a operating panel, and so on is provided to cover an upper portion of the instrument main body. In the operating panel, tone escape portions are provided at right and left regions separated in a direction in which the keys of the instrument main body are arranged. Further, a rear panel is erected on the upper panel at a rear of the tone escape portions and having a width equal to or larger than the entire width of the keyboard in the direction in which the keys are arranged and a height larger than the length of the key in its longitudinal direction.

12 Claims, 7 Drawing Sheets

KEYBOARD INSTRUMENT

BACKGROUND OF THE INVENTION

1. Field of the Invention

The present invention relates to various kinds of keyboard instruments, including electronic keyboard instruments such as an electronic organ, an electronic piano, and so on.

2. Description of the Related Art

Electronic keyboard instruments such as an electronic organ, an electronic piano, and so on generally have a keyboard including many keys being performance operating elements at upper portion of an instrument main body and speakers at under portion of the same, so that a musical sound signal at a pitch selected by key operation of the keyboard is generated by a built-in electronic circuit and transduced into acoustic sound by the speakers, thereby emitting a musical sound.

For example, in an electronic keyboard instrument described in JP 2002-244661A, a pair of right and left speaker boxes are provided under a key bed for holding the keyboard of the instrument main body.

Further, there is another instrument as found in JP 2002-297141A, in which a part of the speakers being a sound generator (a speaker for high tones) is located at upper portion of a case of the instrument main body, and a tone emitting portion for the tone generated by the speaker is formed between a top panel and a keyboard cover thereunder.

In any of such conventional electronic keyboard instruments, however, acoustic waves mainly directly emitted from the speaker being a sound generator to the front side (performer side) are heard by the performer and audience. Further, as found also in the aforementioned patent documents, a music stand board and a keyboard cover opened are generally erected at upper portion of the instrument main body, which are provided on the front side of the tone emitting portion, and therefore may interfere with tone emission from the tone emitting portion and cannot even in the least provide echo effect.

There is another instrument in which the speaker is located such that its vibration surface horizontally lies at a rear of the keyboard to make a thin instrument main body. This arrangement, however, brings about a problem of difficulty in the performer hearing tones from the speaker.

Hence, to solve the problem, the speaker is located at the rear of the keyboard and inclined to face the performer as in the instrument disclosed, for example, in JP 2720459B. However, a sufficient volume of the speaker box cannot be ensured, failing to make sound quality better especially within a low range.

As described above, acoustic waves emitted from the tone emitting portion of the sound generator such as a speaker or the like are not sufficiently effectively used in the conventional electronic keyboard instrument, leaving room for improvement in entertaining the performer and audience with a sufficiently rich and powerful performance tone.

Further, the instrument main body (case) of the keyboard instrument is generally constituted of a holding portion for holding a keyboard, side panels on both sides thereof, a back panel on the rear side, a key slip on the front side, and an upper surface cover member covering the upper portion on the rear side of the keyboard. To secure the rear portion and the front portion of the upper surface cover member to the back panel and the side panels, screwing is required at many points. In addition, the screwing is performed using attachments on the lower surface side to hide the screws from view form outside, and thus the attachment work consumes considerable effort and cost.

There is still another instrument in which the upper surface cover member is composed of a fixed portion fixed to the top portion of the instrument main body and an opening/closing cover portion for opening/closing the keyboard, and opening/closing of the opening/closing cover portion is damped by a damper mechanism attached to the instrument main body. In the instrument, however, since a strong reaction force acts when the opening/closing cover portion is closed using the damper mechanism, the fixed portion on the front side may be lifted up and peel off from the instrument main body.

SUMMARY OF THE INVENTION

The present invention has been developed to solve the above-described problems and has a first aspect to make it possible, in a keyboard instrument such as an electronic keyboard instrument or the like, to use more effectively acoustic waves emitted from a tone emitting portion of a sound generator, thereby providing entertainment of rich and powerful performance tones.

Further, the invention has a second aspect to facilitate attachment of the above-described upper surface cover member to the instrument main body, and has a third aspect to prevent the fixed portion of the upper surface cover member from being lifted up from the instrument main body due to a reaction force caused by the damper mechanism when the opening/closing cover is closed.

A first keyboard instrument according to the invention is a keyboard instrument including a keyboard including a plurality of keys, an instrument main body having a sound generator at a rear of the keyboard, and an upper surface cover portion provided at the rear of the keyboard to cover an upper portion of the instrument main body, the keyboard instrument including, to achieve the above-described first aspect: tone escape portions provided in the upper surface cover portion at right and left regions separated in a direction in which the keys of the instrument main body are arranged; and a rear panel erected on an upper surface of the upper surface cover portion and at a rear of the tone escape portions and having a width equal to or larger than the entire width of the keyboard in the direction in which the keys are arranged and a height larger than a length of the key in a longitudinal direction thereof.

A second keyboard instrument according to the invention is a keyboard instrument including a keyboard including a plurality of keys, an instrument main body having a sound generator at a rear of the keyboard, an operating panel provided at the rear of the keyboard and having many operating elements for musical sound parameters setting arranged thereon, and an upper surface cover member to cover an upper portion of the instrument main body other than the keyboard and a portion of the operating panel, the keyboard instrument including, to achieve the above-described first aspect: tone escape portions provided in the operating panel at right and left regions separated in a direction in which the keys of the instrument main body are arranged; and a rear panel erected on an upper surface of the cover member and at a rear of the tone escape portions and having a width equal to or larger than the entire width of the keyboard in the direction in which the keys are arranged.

In these keyboard instruments, it is preferable that the tone escape portions are provided through which a sound from a speaker box installed under the instrument main body is radiated to exterior of the instrument main body, as a leakage sound, from a through hole formed in a key bed of the instrument main body.

A third keyboard instrument according to the invention is a keyboard instrument including an instrument main body constituted of a holding portion for holding a keyboard including a plurality of keys, side panels on both sides thereof, a back panel, a key slip, and an upper surface cover member engaged with the back panel at a rear of the keyboard, the keyboard instrument including, to achieve the above-described first and second aspect: a rear panel erected on an upper surface of the upper surface cover member and having a width equal to or larger than the entire width of the keyboard in a direction in which the keys are arranged, wherein the back panel and the upper surface cover member are secured to each other via a fixing member secured to either the back panel or the upper surface cover member, and wherein a rear portion of the upper surface cover member is fixed by the fixing member and the rear panel is mounted on the upper surface of the upper surface cover member and secured to the instrument main body, whereby the upper surface cover member is held on the instrument main body.

A fourth keyboard instrument according to the invention is a keyboard instrument similar to the above-described one in which, to achieve the above-described first to third aspect, the upper surface cover member is composed of a fixed portion fixed to the instrument main body and an opening/closing cover portion coupled to the fixed portion via a hinge portion to form an open state opening the keyboard and a closed state covering the keyboard, and the keyboard instrument includes: a rear panel erected on an upper surface of the fixed portion and having a width equal to or larger than the entire width of the keyboard in a direction in which the keys are arranged; and a damper functional member for damping opening/closing of the opening/closing cover portion.

Further, the damper functional member is constituted of a damper mechanism body attached to the instrument main body and a stay having one end pivotably held on the damper mechanism body and the other end pivotably held on the opening/closing cover portion at a position distanced from the hinge portion, the fixed portion covers an upper portion of the instrument main body other than the keyboard, and the back panel and the upper surface cover member are secured to each other via a fixing member secured to either the back panel or the upper surface cover member.

Further, a rear portion of the fixed portion is fixed by the fixing member and the rear panel is mounted on the upper surface of the fixed portion and secured to the instrument main body, whereby the fixed portion is held on the instrument main body.

A fifth keyboard instrument according to the invention is a keyboard instrument including an instrument main body having a keyboard including a plurality of keys and mounted on a key bed, a musical sound signal generating means for generating a musical sound signal by operation of the keys, a speaker for transducing the musical sound signal from the musical sound signal generating means into the acoustic sound, and an operating panel located at a rear of the keyboard, wherein, to achieve the above-described first object, a speaker box for holding the speaker is fixedly provided on a lower surface of the key bed of the instrument main body, and a through hole is provided which passes from inside the speaker box to an upper surface of the key bed, and wherein a tone escape portion is provided in the operating panel above the through hole, or a clearance for tone emission is provided between an upper portion of the rear of the keyboard and a cover of the instrument main body.

In this keyboard instrument, it is preferable that a speaker for high tones is provided on the key bed and near the through hole. And it is also preferable that the speaker box functions a leg supporting the instrument main body.

Further, at least one of the tone escape portion and said clearance for tone emission is provided through which a sound from the speaker box is radiated to exterior of the instrument main body, as a leakage sound from the through hole.

In both the first and second keyboard instruments according to the invention, the above-described rear panel serves as a sound reflector so that an acoustic wave emitted backward from the tone emitting portion of the sound generator is reflected frontward and effectively utilized, thus presenting a rich musical sound and also creating a feeling of spreading. Especially when a tone emitting portion of a speaker for high tones is provided at upper portion of the instrument main body, a musical sound emitted therefrom never scatters backward but returns to the performer side, creating a rich musical sound. As for low musical sounds, by providing a hole in the upper surface of the speaker box, an acoustic wave leaking from the hole is emitted in the upward direction of the instrument main body via the tone escape portion and reflected by the rear panel to the performer side and thus overlapped with the direct tone from the speaker, creating a rich sound.

Further, the second keyboard instrument is provided with the tone escape portion in the operating panel surface, so that the effort to form tone emitting holes can be reduced.

According to the third keyboard instrument, in addition to the aforementioned effects, the rear panel serves as a weight for the upper surface cover member, so that the upper surface cover member never lifts up only by screwing the rear portion of the upper surface cover member to the back panel without screwing its front portion to the side panels, facilitating the attachment work and also reducing the cost.

According to the fourth keyboard instrument, the rear panel can suppress and prevent lift up of the front portion of the fixed portion due to the damper action of the damper functional member when the opening/closing cover portion of the upper surface cover member is closed.

According to the fifth keyboard instrument, an electronic keyboard instrument can be obtained which provides performance tones from the speaker that the performer easily hears and have sound quality excellent especially in a low range. Provision of the speaker for high tones on the key bed and near the through hole enables the performer to hear clearly tones also in a high range.

The above and other objects, features and advantages of the invention will be apparent from the following detailed description which is to be read in conjunction with the accompanying drawings.

BRIEF DESCRIPTION OF THE DRAWINGS

All of the drawings show an example of a keyboard instrument according to the invention, wherein of FIG. 1 is a plan view showing the whole.

DETAILED DESCRIPTION OF THE PREFERRED EMBODIMENTS

Hereinafter, a preferred embodiment for implementing the invention will be concretely described based on the drawings.

Figure 1:
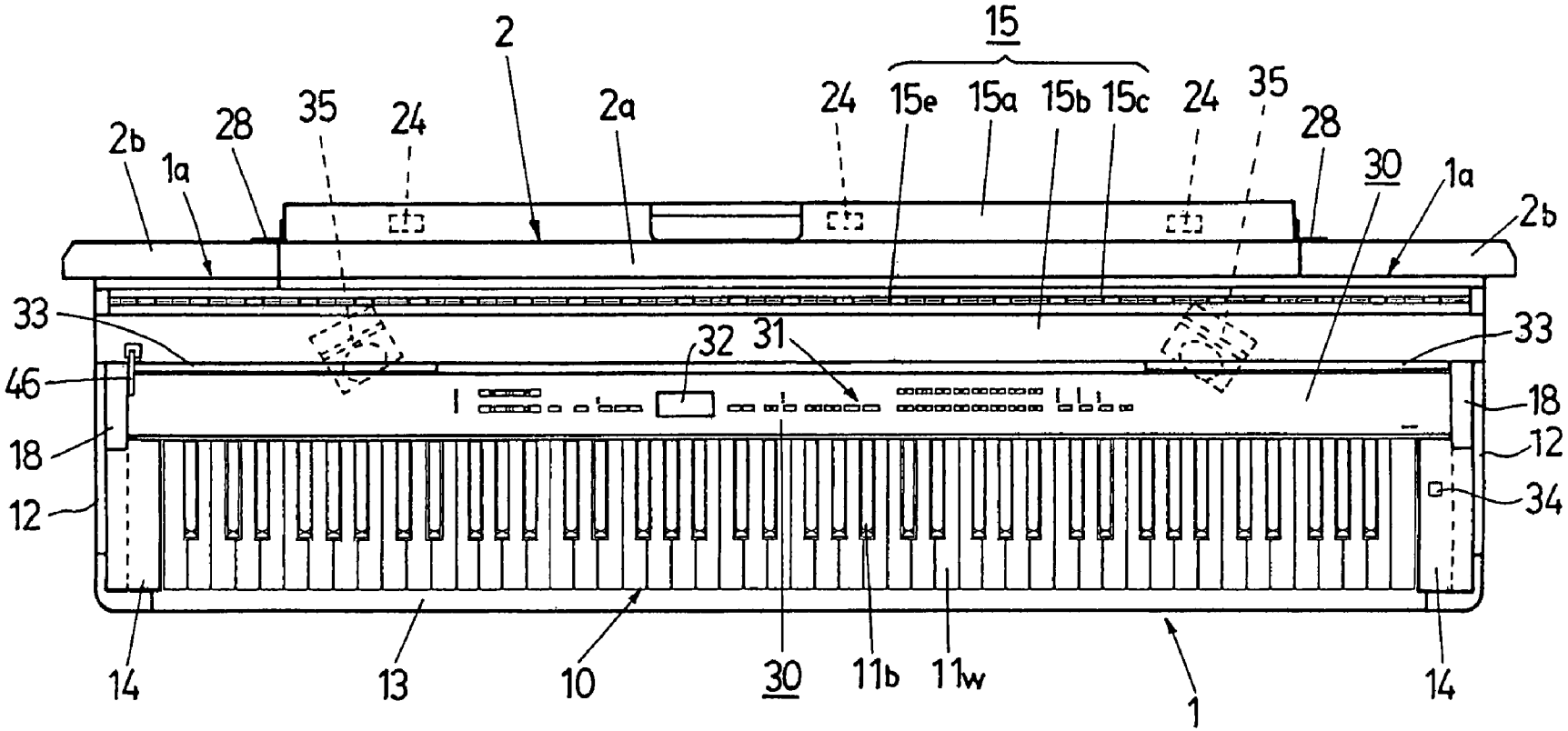
Figure 2:
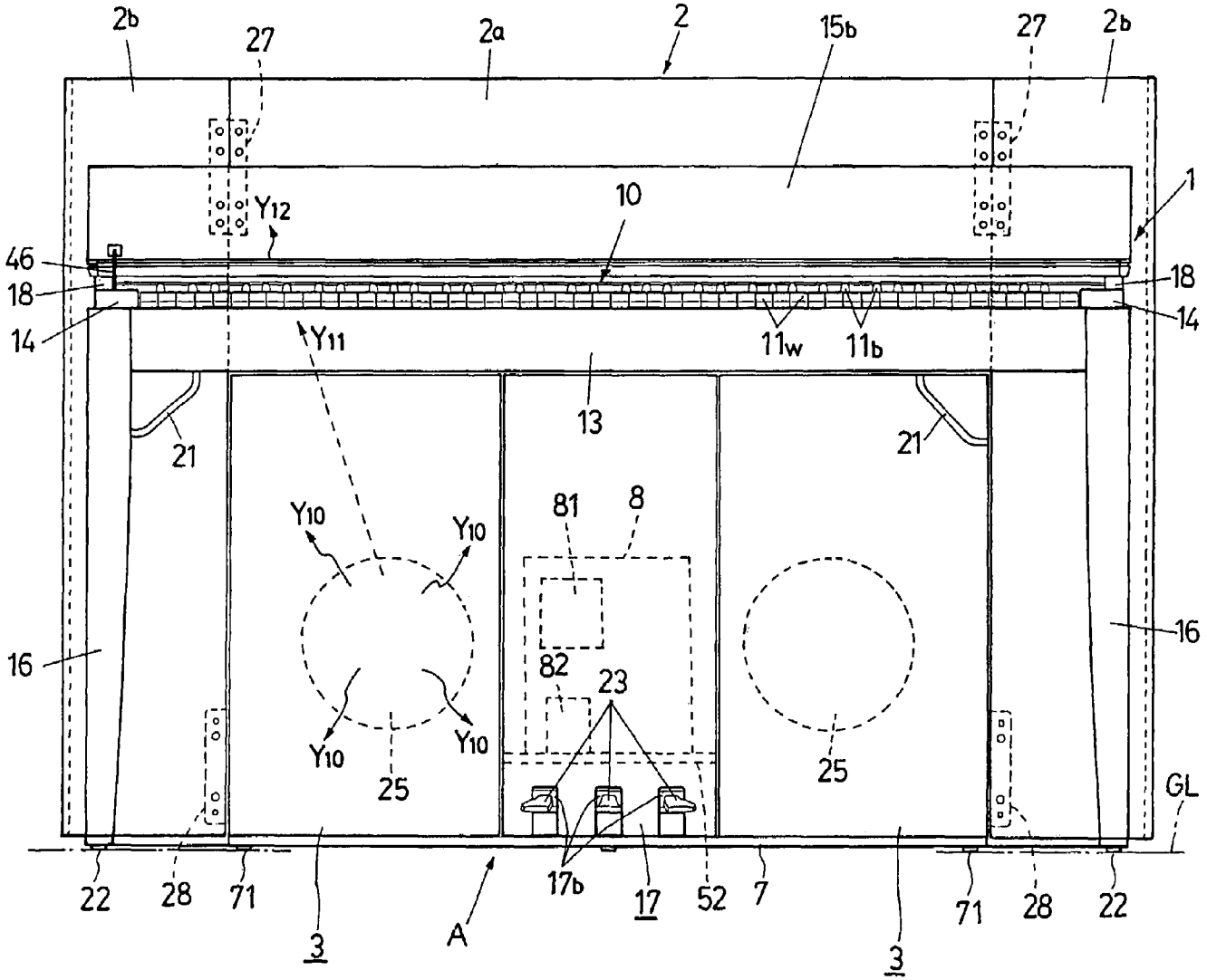
FIG. 2 is a front view, and of FIG. 3 is a side view.
Figure 3:
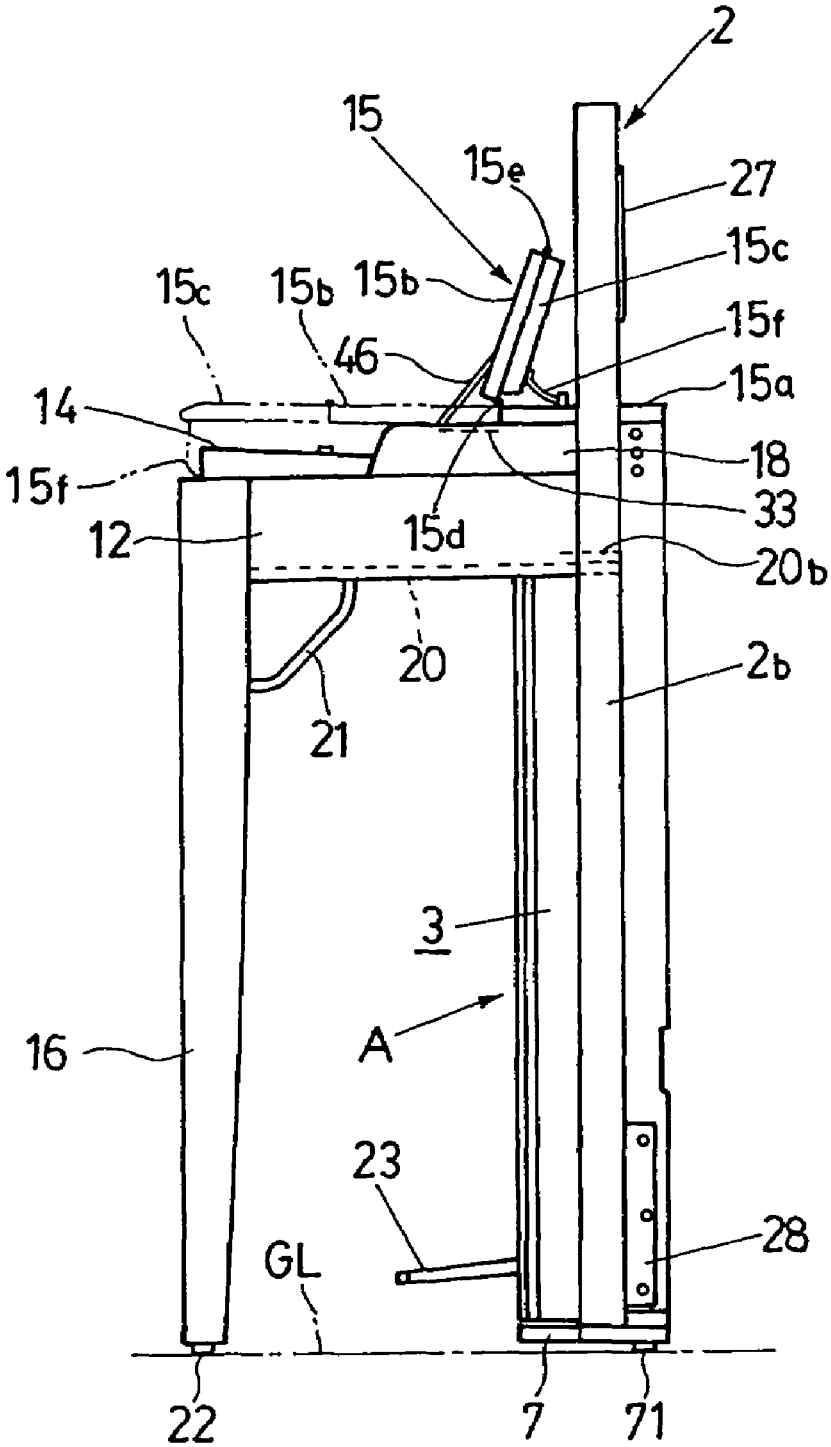
Figure 4:
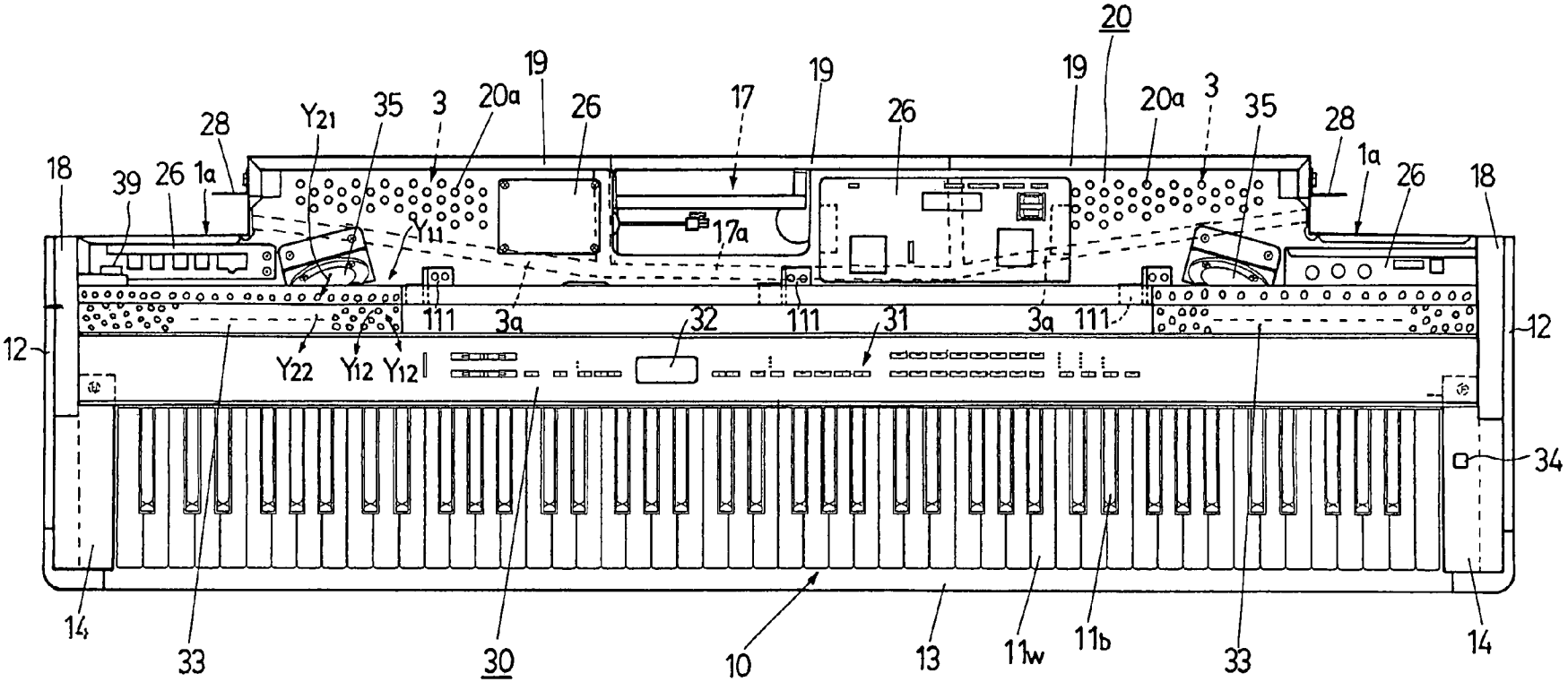
FIG. 4 is an enlarged plan view showing an instrument main body with its upper surface cover member removed therefrom.

FIG. 1 is a plan view showing an example of a keyboard instrument according to the invention, FIG. 2 is a front view, FIG. 3 is a side view, and FIG. 4 is an enlarged plan view showing an instrument main body with its upper surface cover member removed therefrom.

This example is an electronic keyboard instrument embodying an electronic piano or an electronic organ, and this electronic instrument comprises, as shown in those drawings, an instrument main body 1 having a keyboard 10 including a plurality of keys, that is, white keys 11*w* and black keys 11*b* and having a sound generator at the rear of the keyboard 10, a supporting member A supporting the instrument main body 1, and a rear panel 2.

The rear panel 2 is composed of a pair of vertical panels 2*b*, which are located at the rear and on both sides of the instrument main body 1 and extended from a lower position of the supporting member A to the upper side of the keyboard 10, and a crossbeam panel 2*a* which bridges them on the keyboard 10 and coupled to the vertical panels 2*b*. This rear panel 2 serves both as a decoration board and a sounding board.

The instrument main body 1 includes a key bed 20 (shown in FIG. 3 and FIG. 4) being a holding portion for holding the keyboard 10, side panels 12 on both right and left sides, three back panels 19 shown in FIG. 4, and a key slip 13 provided on the front side of the keyboard 10. Further, the instrument main body 1 includes a pair of key blocks 14 on both right and left sides of the keyboard 10 and an upper surface cover member 15 provided at the rear of the keyboard 10 and engaged with the back panels 19. One of the key blocks 14 is provided with a power switch 34.

As shown in FIG. 2 and FIG. 3, a pair of right and left front legs 16 for supporting the instrument main body 1 are attached to front end portions of the side panels 12 on both sides of the instrument main body 1. Further, stays 21 made of metal are attached, through use of not-shown metal fittings, extending from the inner surfaces at middle portions of the front legs 16 to the back surface of the key bed 20. Lower portions of the front legs 16 extend down to a floor GL, and their lower end surfaces have casters 22 attached thereto.

Between the right and left front legs 16 at the rear of the keyboard 10 and under the key bed 20, a pair of speaker boxes 3 are provided with a middle box portion 17 intervening therebetween. The middle box portion 17 and the speaker boxes 3 on both sides thereof are integrally formed to constitute a supporting member A for supporting the instrument main body 1 and also serve a function as a rear leg. At a lower portion of the middle box portion 17, three pedal keys 23 are provided.

The crossbeam panel 2*a* of the rear panel 2 provided at the rear of the main body 1 has almost the same width as the width of the supporting member A, and the vertical panels 2*b* on both sides thereof has the same height as the top end of the crossbeam panel 2*a*. The crossbeam panel 2*a* and each of the vertical panels 2*b* are coupled with each other by a fixing member (metal fitting) 27 on the respective rear surface sides, and each of the vertical panels 2*b* is also fixed to the speaker box 3 by a fixing member (metal fitting) 28 on the rear surface sides.

Further, lower end portions of the supporting member A including the speaker boxes 3 and the vertical panels 2*b* on both sides thereof are fixed to the top of a coupling base member 7 for coupling them. Note that the coupling base member 7 also has casters 71 attached to its lower surface.

In the pair of speaker boxes 3, speakers for low tones (squawker or woofer) 25 being sound generators are installed facing the front side (performer side) as shown by broken lines in FIG. 2. Further, the speaker boxes 3 on the right and left sides, the structure of which will be described later in detail, are configured such that their horizontal cross sections are in the form of an almost triangle and their speaker attachment surfaces face outward respectively. In addition, the presence of the rear panel 2 as a sound reflector, especially the right and left vertical panels 2*b* limits rearward emission of tones. When rearward tone emission characteristics need to be increased on a stage or the like, the rear panel 2 can be even removed.

The upper surface cover member 15, as clearly shown in FIG. 3 in this example, is constituted of an upper panel (corresponding to a top panel) 15*a* covering the upper surface of the rear of the instrument main body 1, a first opening/closing panel 15*b* coupled to the upper panel 15*a* via a hinge portion 15*d*, and a second opening/closing panel 15*c* coupled to the first opening/closing panel 15*b* via a hinge portion 15*e*.

The upper panel 15*a* is a fixed portion that is engaged to the top end portions of the back panels 19 (FIG. 4) by fixing members 24 (shown by broken lines in FIG. 1) implemented by L-shape metal fittings and screws and thereby fixed to the instrument main body 1.

Then, the first opening/closing panel 15*b* and the second opening/closing panel 15*c* constitute an opening/closing cover portion which are brought into an open state to open the keyboard 10 as shown by a solid line in FIG. 3 and a closed state to cover it as shown by an imaginary line. To a tip portion of the second opening/closing panel 15*c*, a cover piece 15*f* for covering the front side of the keyboard 10 in the closed state is attached over the entire length in the width direction. The first opening/closing panel 15*b* is coupled to a later-described damper functional member via a stay 46 shown in FIG. 1. Note that the opening/closing cover portion is not essential to the invention.

Further, at the rear of the keyboard 10, as shown in FIG. 1 and FIG. 4, an operating panel 30 is provided on which many operating elements 31 for musical sound parameter setting, a liquid crystal display 32, and so on are arranged. The operating panel 30 also covers the upper portion of the instrument main body, and is thus called as an upper surface cover portion together with the upper panel 15*a* of the upper surface cover member 15. On both right and left sides of the operating panel 30, a pair of keyboard concealing side panels 18 are provided.

Further, as shown in FIG. 4, tone escape portions 33 are provided at right and left regions of the operating panel 30 separated in a direction in which the keys of the instrument main body 1 are arranged. The tone escape portions 33 can be formed by forming openings for emitting tones in the operating panel 30 and providing a decorative sheet such as a saran net, punching metal, or the like over the upper surface of the panel to cover the openings. Alternatively, the tone escape portions 33 may be formed by performing press or punching work on a metal plate during formation of the panel surface of the operating panel 30. This can reduce effort to form tone emitting holes.

FIG. 4 is a view of the keyboard instrument of this example with the upper surface cover member 15 removed, looking from above, in which the key bed 20 is seen at the rear of the operating panel 30. The rear end portion of the operating panel 30 is fixed to the key bed 20 by supporting metal fittings 111 at a plurality of points.

In this example, a portion of the key bed 20 is used also as an upper panel of each of the speaker boxes 3. Under the key bed 20, the supporting member A is provided which is constituted of the middle box portion 17 and the speaker boxes 3 on both sides thereof. Numeral 17*a* shown by a broken line denotes a front panel of the middle box portion 17, and numerals 3*a* denote baffle plates of the speaker boxes 3. A thick saran net, not illustrated, is extended to form a curved surface over the front surfaces of the front panel 17*a* and the baffle plates 3*a*.

A plurality of electric circuit blocks 26 are mounted within regions on the upper surface of the key bed 20, the regions corresponding to the middle box portion 17 and portions of the pair of speaker boxes 3 close to the middle box portion 17. On the other hand, within regions corresponding to other than the aforementioned portions of the pair of speaker boxes 3, many through holes 20*a* are formed passing from the inside of the speaker boxes 3 to the upper surface of the key bed 20, so that these regions also form tone escape portions. Accordingly, an acoustic wave from the speaker for low tones 25 in each of the speaker boxes 3 is radiated frontward as shown by arrows Y10 in FIG. 2 and also radiated upward and to the rear as shown by a broken arrow Y11. The acoustic wave, as shown by a solid line arrow Y11 in FIG. 4, passes through the many through holes 20*a* in the key bed 20 serving also as the upper panel of the speaker box and is emitted into the above space between the key bed 20 and the operating panel 30 and the upper panel 15*a*, and further radiated upward and frontward as shown by arrows Y12 from the tone escape portion 33 of the operating panel 30.

Further, as shown in FIG. 1 and FIG. 4, in the space between portions near the through holes 20*a* on the key bed 20 and the back side of the operating panel 30, a pair of right and left speakers for high tones (tweeters) 35 being sound generators are arranged such that their tone emission center lines are pointed frontward and somewhat upward and, further, slightly rotated in directions in which they intersect with each other. Accordingly, an acoustic wave emitted from the speaker for high tones 35 as shown by an arrow Y21 in FIG. 4 also passes through the tone escape portion 33 of the operating panel 30 and is then radiated upward and frontward as shown by an arrow Y22.

The rear panel 2 is erected on the upper surface of the upper panel 15*a* of the upper surface cover member 15 and at the rear of the tone escape portions 33 of the operating panel 30 being the upper surface cover portion, and has a width equal to or larger than the entire width of the keyboard 10 in the direction in which the white keys 11*w* and the black keys 11*b* are arranged and a height larger than the length of the key in its longitudinal direction. The length of the key in this case means the length of the white key 11*w*, and the length may be the length of an exposed visible portion or may be the length including an invisible rear end portion hidden behind the operating panel 30. In addition, when the opening/closing cover portion (composed of the first and second opening/closing panels 15*b* and 15*c*) is provided as in this example, the rear panel 2 is made to be larger in height than the opening/closing cover portion in the open state as shown in FIG. 2.

Provision of the rear panel 2 as described above allows tones generated from the speakers 25 and 35 are directly reflected by the rear panel, so that the direct tones and reflected tones slightly shifted in phase therefrom reach the performer. Therefore, the performer will hear the direct tones from the speakers and the reflected tones slightly shifted in phase therefrom in a mixed manner and thus can hear tones improved in hearing feeling.

Further, in this example, the rear panel 2 is constituted of the single crossbeam panel 2*a* having a width smaller than the entire width of the keyboard 10 in the direction of key arrangement, and the two vertical panels 2*b* holding the crossbeam panel 2*a* therebetween, all of those panels being made of wood. Further, the crossbeam panel 2*a* is mounted on the upper surface of the upper panel 15*a* to serve a function as the sound reflector for the acoustic waves emitted from the tone escape portions 33 as well as a role of weight for the upper panel 15*a*. The upper portions of the two vertical panels 2*b* also serve a function as the sound reflector similarly to the crossbeam panel 2*a*. Besides, the lower portions of the two vertical panels 2*b* also serve as the sound reflector against turning back of acoustic waves radiated frontward from the speakers for low tones 25.

It should be noted that the rear panel 2 may be constituted of a single crossbeam panel having a width equal to or larger than the entire width of the keyboard 10 in the direction of key arrangement and a height larger than the length of the white key 11*w* in its longitudinal direction, and a pair of vertical panels supporting the crossbeam panel at the upper end surfaces.

According to this example, the rear panel 2 not only increases decorativeness of the electronic keyboard instrument but also serves as the sound reflector for the acoustic waves emitted from the tone escape portions 33 and so on, thus presenting rich musical sounds and also creating a feeling of spreading. Especially, musical sounds emitted from the speakers for high tones 35 do not scatter but return to the performer side, resulting in rich musical sounds. As for low musical sounds, acoustic waves leaking via the through holes 20*a* in the upper surfaces of the speaker boxes 3 through the key bed 20, and the tone escape portions 33 are reflected frontward, and the acoustic waves radiated to the front of the speaker boxes 3, when turning back to the rear, are also reflected by the vertical panels 2*b*, so that the direct tones and the reflected tones are overlapped to create rich musical sounds.

Note that the upper surface cover member 15 may be constituted only of a fixed upper panel 15*a* covering the upper portion of the instrument main body 1 other than the keyboard 10 and the operating panel 30. In this case, the upper panel 15*a* and the operating panel 30 constitute the upper surface cover portion. The operating panel 30 is provided between the keyboard 10 and the upper panel 15*a*.

In the case in which the upper surface cover member 15 is provided with the opening/closing cover portion, the opening/closing cover portion is arranged such that when it is in the open state to open the keyboard 10, a portion of each of the tone escape portions 33 of the operating panel 30 is exposed on the front side of the second opening/closing panel 15*c* and the other majority portion is exposed at the rear of the first opening/closing panel 15*b*, whereby sufficient sound reflection effect by the rear panel 2 can be obtained.

Further, in this example, the back panels 19 are secured to the upper panel 15*a* via the fixing members 24 secured to either the back panels 19 or the upper panel 15*a* of the upper surface cover member 15, so that the rear portion of the upper panel 15*a* is fixed by means of the fixing members 24, and the crossbeam panel 2*a* of the rear panel 2 is mounted on the upper surface of the upper panel 15*a* and secured to the instrument main body 1, whereby the upper panel 15*a* is held on the instrument main body 1.

Accordingly, when the upper panel 15*a* for covering and hiding the upper surface of the instrument main body 1 is secured to the back panels 19, the rear panel 2 mounted on the upper panel 15*a* can serve as a weight, thus decreasing the number of screwed points by means of the fixing members 24, without their peeling away due to the decreased screwed points. In addition, their assembly work can be easily performed.

Next, the structure of the supporting member constituting the speaker box and its state attached to the instrument main body will be described in detail with FIG. 5 and FIG. 6.

Figure 5:
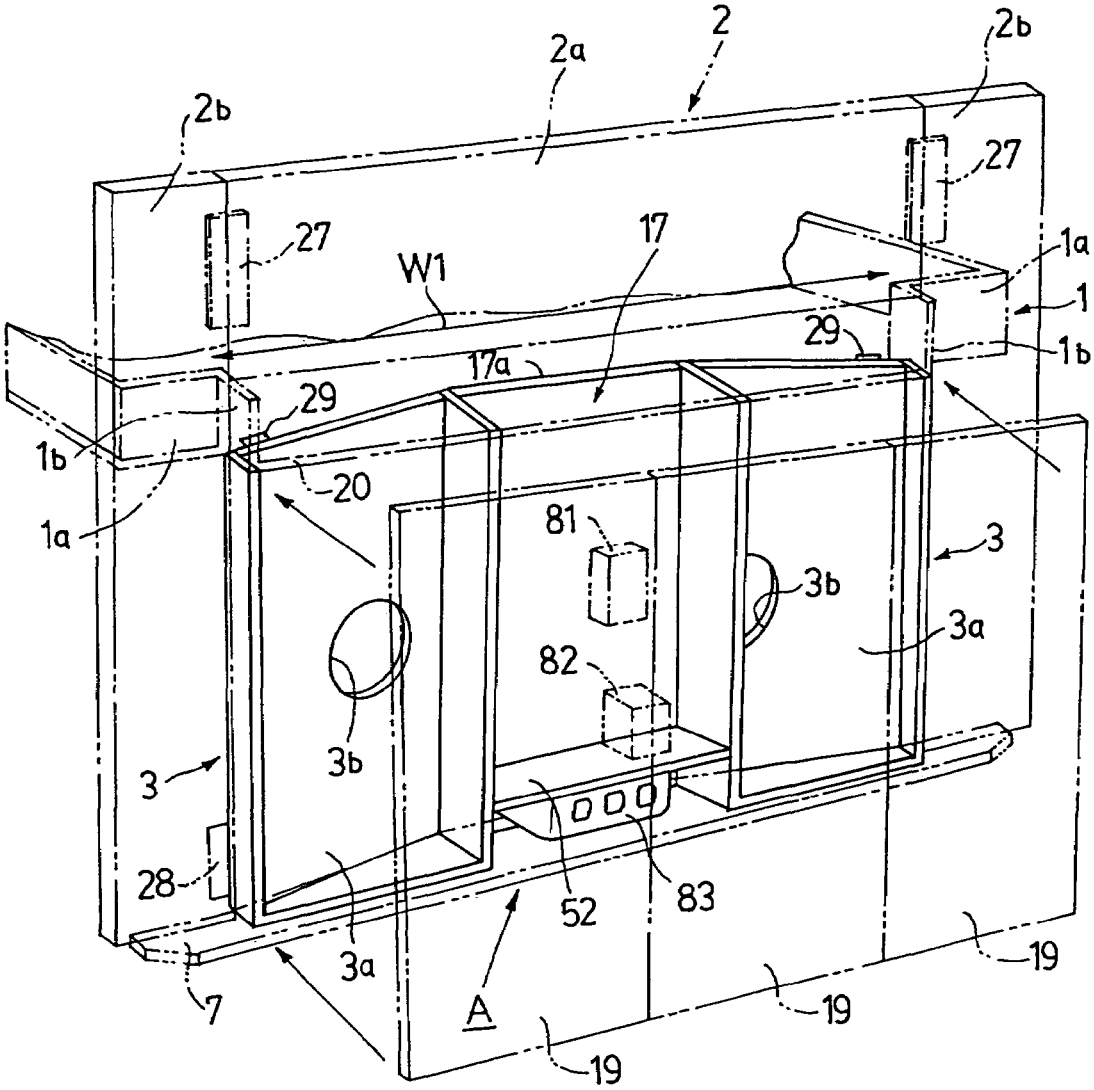
FIG. 5 is a schematic perspective view showing a state of a supporting member constituting a speaker box with its back panel removed therefrom and an attachment positional relation between portions around the supporting member.

As shown in FIG. 5, the pair of right and left speaker boxes 3 are integrally provided on both sides of the middle box portion 17. On the front surfaces of the speaker boxes 3, the baffle plates 3*a* are provided which are formed with speaker attachment holes 3*b*, and on the front surface of the middle box portion 17, the front panel 17*a* is provided. Over the front surfaces of the front panel 17*a* and the baffle plates 3*a*, the saran net is extended as described above. Further, to the back of the middle box portion 17 and the speaker boxes 3, the back panels 19 are attached respectively.

Further, at a lower portion of the middle box portion 17, a horizontal panel bridge member 52 is provided which bridges partition panels between the middle box portion 17 and the speaker boxes 3 on both sides. The pair of speaker boxes 3, the middle box portion 17, the horizontal panel bridge member 52, and the back panels 19 are integrally assembled to constitute the supporting member A for supporting the instrument main body 1.

In this supporting member A, an electric circuit portion 8 (shown by a broken line in FIG. 2) including a controller 81 (musical sound signal generating means) for generating a musical sound signal on the basis of a key operation of the keyboard 10 is housed in the middle box portion 17. Note that the controller 81 is constituted of an electronic circuit board for generating a digital musical sound signal by a CPU or a sound source chip. Further, a transformer 82 of the electric circuit portion 8 is fixedly mounted on the horizontal panel bridge member 52.

In the space under the horizontal panel bridge member 52, a pedal holding frame 83 is attached, so that the three pedals 23 shown in FIG. 2 are swingably supported by the pedal holding frame 83. Then, operation portions of the pedals 23 are exposed to the performer side via pedal opening portions 17*b* (FIG. 2) formed at the lower end portion of the front panel 17*a*.

Figure 6:
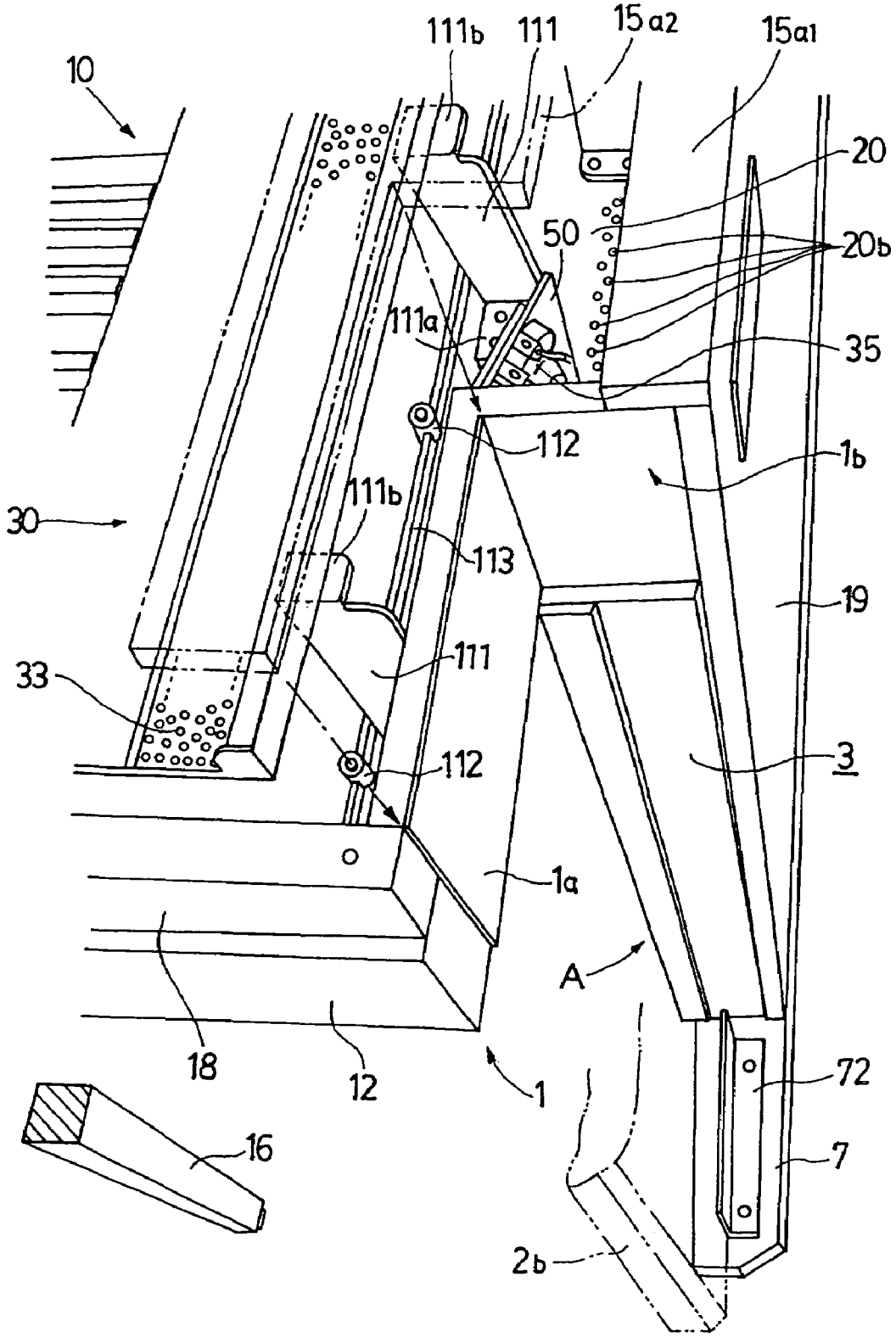
FIG. 6 is a perspective view showing an attachment state of the instrument main body and the speaker box on the right side.

As clearly shown in FIG. 6, stepped portions (surfaces of large cut portions) 1*a* are formed at the rear and on both sides of the instrument main body 1, and the vertical panels 2*b* of the rear panel 2 abut on the stepped portions 1*a* and is fixed at their lower end portions by means of fixing metal fittings 72 on the coupling base member 7 side. A portion on the middle side between the stepped portions 1*a* of the rear portion of the instrument main body 1 forms a coupling box portion 1*b* projecting in a rectangular shape coupling with the speaker boxes 3. The width w1 (shown in FIG. 5) of the coupling box portion 1*b* is the same as the width of the supporting member A, so that the coupling box portion 1*b* is mounted on and fixed to the supporting member A. Note that the key bed 20 of the instrument main body 1 and the speaker boxes 3 of the supporting member A are secured to each other by L-shaped attachment metal fittings 29 at the top ends of the speaker boxes 3 shown in FIG. 5.

The rear end portion of the control panel 30 is fixed to the key bed 20 by the supporting metal fittings 111. The supporting metal fitting 111 is in a plate shape, in which a lower piece 111*a* and an upper piece 111*b* are bent opposite in the horizontal direction and the lower piece 111*a* is secured to the key bed 20 and the upper piece 111*b* is secured to the rear end portion of the operating panel 30.

Further, a keyboard frame including a rib 113, which is placed along the width direction of the instrument main body 1, is mounted on the key bed 20 and fixed with screws from the top of bosses 112, which are provided at some intervals in the rib 113, toward the key bed 20. The keyboard frame is a frame supporting the keyboard 10, but its details will be omitted.

In the space between the key bed 20 and the operating panel 30, the speakers for high tones 35 are located such that they are attached to an attachment panel 50.

The other portions shown in FIG. 5 and FIG. 6 have already been described with other drawings, and therefore their description is omitted here. Note that the upper panel 15*a* of the upper surface cover member 15 is split into two upper panels 15*a*1 and 15*a*2 in FIG. 6 but, as a matter of course, may be a single upper panel 15*a* as shown in FIG. 3 and later-described FIG. 7.

Figure 7:
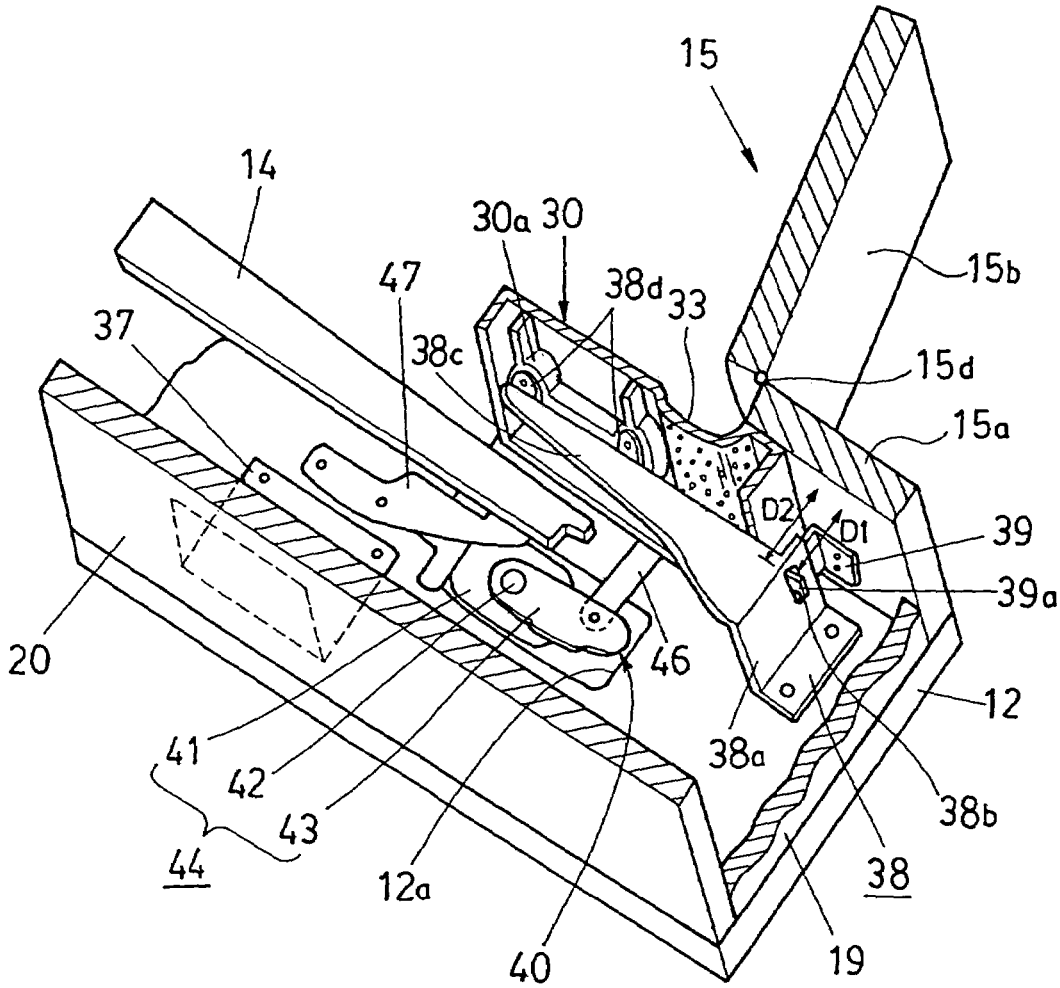
FIG. 7 is a perspective view of a portion provided with a damper functional portion with the back panel removed, looking diagonally from below and somewhat to the rear.

FIG. 7 is a perspective view of a portion provided with a damper functional portion of this embodiment with the back panel removed, looking diagonally from below and somewhat to the rear.

The keyboard instrument of this example includes a damper functional member 40 for damping opening/closing operation of the opening/closing cover portion composed of the first and second opening/closing panels 15*b* and 15*c* coupled to the upper panel 15*a* of the upper surface cover member 15.

In FIG. 7, illustration of the second opening/closing panel 15*c* of the upper surface cover member 15 is omitted, and the back panel 19 is omitted in the illustration with just a small portion left thereof. Numeral 20 denotes the key bed screwed and fixed to the inner surface of the side panel 12 via an L-shaped metal fitting 37, the key bed 20 holds the above-described keyboard 10.

The side portion of the operating panel 30 is supported and fixed by a operating panel supporting member 38 which is screwed and fixed to the inner surface of the side panel 12 and bent in a shape of clank-arm.

More specifically, attachment pieces 38*d* extending from an arm portion 38*c* of the operating panel supporting member 38 and bent in parallel to the panel surface are screwed and fixed to boss portions 30*a* formed on the back surface of the operating panel 30, so that the operating panel 30 is integrated with the operating panel supporting member 38, and then a base portion of the operating panel supporting member 38 is screwed to the side panel 12.

A straight standing portion 38*a* of the operating panel supporting member 38 is provided with a backlash hole 38*b*, so that a lower piece portion 39*a* of a U-shaped reaction preventing metal fitting 39 secured to the lower surface of the upper panel 15*a* is inserted into the backlash hole 38*b* to prevent reaction of the upper panel 15*a* during opening/closing of the first opening/closing panel 15*b*.

The lower piece portion 39*a* of the reaction preventing metal fitting 39 is structured such that it slants downward toward the tip and the relation between a distance D1 from the upper edge of the backlash hole 38*b* to the lower surface of the upper panel 15*a* and a distance D2 from the base of the lower piece portion 39*a* to the lower surface of the upper panel 15*a* becomes such that D1 is slightly larger than D2 (the difference therebetween becomes 0 to 2 mm). Owing to this structure, push operation by one-touch operation from the front side to the rear side can couple the upper panel 15*a* to the instrument main body 1. By screwing from behind the L-shaped fixing members 24 shown by the broken lines in FIG. 1 in this state, the back panels 19 and the upper panel 15*a* are secured to each other while the fit between the lower piece portion 39*a* and the backlash hole 38*b* becomes stronger. However, this is not essential to the invention.

The damper functional member 40 is constituted of a damper mechanism body 44 in which a damper unit 41 which is located in a recess portion 12*a* formed on the inner surface side of the side panel 12 of the instrument main body 1 and attached to the same is coupled to a lever 43 via a torque shaft 42, and a stay 46 having one end pivotably held by a shaft 45 on the lever 43 of the damper mechanism body 44 and the other end pivotably held on the opening/closing cover portion at a position separated from the hinge portion 15*d* of the first opening/closing panel 15*b*.

The key block 14 is secured to the instrument main body 1 by a key block fastening 47 attached to the inner surface of the side panel 12.

Also in this case, the rear portion of the upper panel 15*a* is fixed by the fixing members 24 shown in FIG. 1 and the rear panel 2 is mounted on the upper surface of the upper panel 15*a* and secured to the instrument main body 1, whereby the upper panel 15*a* being the fixed portion is held on the instrument main body 1.

This arrangement can provide the above-described effect and ensure that when the closing action of the first opening/closing panel 15*b* being the opening/closing cover portion is damped by the damper action of the damper functional member 40, the rear panel 2 suppresses and prevents lift up of the front portion of the upper panel 15*a* due to its reaction.

Further, to assist the suppression, the upper panel 15*a* and the operating panel supporting member 38 are coupled to each other by the reaction preventing metal fitting, whereby the upper panel 15*a* being the fixed portion is locked to the instrument main body 1 at all times, thereby making it possible to prevent more securely lift up of the upper panel 15*a* when the opening/closing cover portion is closed.

Note that the shape, size, material, split configuration, and so on of the rear panel are not limited to those shown in the example, but can be arbitrarily changed as a matter of course.

The above configuration ensures that the instrument main body 1 is supported on the pair of right and left front legs 16 fixed to the front end portions of the side panels 12 and the supporting member A at the rear. The speaker boxes 3 extending down to the floor have a large vertical dimension and ensures a large volume in the vertical direction. This makes the sound characteristics better especially in a low renge. Further, the tones from the back of the speakers for low tones 25 travel from the inside of the speaker boxes 3 to the upper portion, pass through the many through holes 20*a* in the key bed 20, and are led to the coupling box portion 1*b* of the instrument main body 1 and emitted to the performer side via the tone escape portions 33 (many through holes) of the operating panel 30.

Accordingly, the performer hears well musical sounds with excellent low tone characteristics. Further, the tones from the speakers for high tones 35 are also emitted from the tone escape portions 33 of the operating panel 30. This also makes the sound characteristics better in a middle and high renge.

In addition, the speaker boxes 3 have a small thickness in the front-to-rear direction, so that the instrument main body 1 and thus the entire keyboard instrument becomes thin in the front-to-rear direction, resulting the instrument giving no feeling of oppression to the performer.

Further, since the middle box portion 17 is provided between the right and left speaker boxes 3 and the pedals 23 are arranged in the lower portion thereof, the pedals 23 have increased stability in the depth direction and are easy to operate. In other words, the lower ends of the speaker boxes 3 connected to the middle box portion 17 are fixed to the floor because of the empty weight of the instrument, thus fixing the pedal holding frame 83 shown in FIG. 5 and stabilizing the pedals 23.

The pedals become more stable in the depth direction than in a conventional instrument in which, for example, a rod-shaped member is extended, under the instrument main body, downward from the lower surface of the key bed located considerably far away from the floor, and a pedal unit is attached to the lower portion of the member. Further, the weight of, for example, the transformer 82 of the electric circuit portion 8 housed in the middle box portion 17 further increases the operation stability of the pedals 23 and the stability of the whole instrument.

All of the electric circuit blocks 26 on the key bed 20 shown in FIG. 4 may also be housed in the middle box portion 17.

Further, by housing the various kinds of electric circuit blocks in the middle box portion 17, sound separation between the right and left speakers 25 can be made better, resulting in good characteristics especially in low tones. Further, the weight of the lower portion of the middle box portion 17 is increased, whereby the vector, in which the supporting member A (the rear leg) falls down, points inward (frontward), and the center of gravity of the entire instrument lowers, so that even a thin-profile instrument becomes hard to fall.

In this example, the coupling base member 7 is provided across the lower surfaces of the middle box portion 17 and the right and left speaker boxes 3, thus making the whole supporting member A robust. However, the coupling base member 7 is not essential.

The tone escape portion 33 in this example is constituted of many through holes, but may have any form as long as it can prevent entrance of foreign substance and so on and emit tones. Further, the material of the portion forming the tone escape portion 33 is not limited to metal, but the portion may be formed of resin integrally with the operating panel 30.

Although the tones emitted from the through holes 20*a* formed in the key bed 20 serving also as the upper panels of the speaker boxes 3 are emitted to the performer side from the tone escape portions 33 of the operating panel 30, in place of the tone escape portions 33, a clearance for tone emission communicating with the through holes 20*a* may be provided at a rear of the keyboard 10 and between the rear and the operating panel 30 or the upper surface cover member 15 so that the tones emitted from the through holes 20*a* are emitted from the clearance for tone emission to the performer side. Further, both the tone escape portions 33 and the clearance for tone emission may be provided to emit tones from both of them.

This clearance for tone emission can be configured as follows. For example, in the electronic keyboard instrument of this example, the upper panel 15*a* covering a portion of the instrument main body 1 at the rear of the operating panel 30 may be split into two pieces, and at least one of them is provided at a higher level than the operating panel 30 so that the clearance for tone emission is formed between a rising portion of the upper panel 15*a* and the rear portion of the operating panel 30. In this case, it is suitable to extend the operating panel 30 backward to lay it under one of the upper panels 15*a* so that the clearance for tone emission communicates with, for example, the coupling box portion 1*b* shown in FIG. 6.

Besides, a preferred example in which the speakers for high tones 35 are provided on the key bed 20 near the through holes 20*a* is described in the above-described example, but the speakers for high tones 35 may not be provided.

Further, since the supporting member A has a horizontal cross section in a trapezoidal shape and the speakers 25 are provided on slant surfaces (the baffle plates 3*a*) of the trapezoids, both the speakers 25 exhibit sound characteristics in a hart shape opening frontward and thus are fit for performance even in a wide space such as a stage.

Further, the pair of vertical panels 2*a* of the rear panel 2 are detachably fixed to the instrument main body 1 in the keyboard instrument of this example, and therefore the design for them as the decoration panels can be selected according to a user's order.

Further, the electric circuit portion 8 is secured to the back panel 19 in this example, so that removal of only the front panel 17*a* allows maintenance work to be easily performed on the electric circuit portion 8 therein. Note that if the electric circuit portion 8 is secured to the front panel 17*a*, its maintenance can be performed after removal of the back panel 19.

The invention is applicable to various kinds of electronic keyboard instruments such as an electronic organ, an electronic piano, and so on as a matter of course, but not limited to those, and is widely applicable also to keyboard instruments such as an organ, an upright piano, and so on which are natural instruments.

What is claimed is:

1. A keyboard instrument comprising a keyboard including a plurality of keys, an instrument main body having a sound generator at a rear of the keyboard, and an upper surface cover portion provided at the rear of the keyboard to cover an upper portion of said instrument main body, said keyboard instrument comprising:

tone escape portions provided in said upper surface cover portion at right and left regions separated in a direction in which the keys of said instrument main body are arranged; and a rear panel erected on an upper surface of said upper surface cover portion and at a rear of said tone escape portions and having a width equal to or larger than the entire width of said keyboard in the direction in which the keys are arranged and a height larger than a length of the key in a longitudinal direction thereof.

2. The keyboard instrument according to claim 1, wherein said tone escape portions are provided through which a sound from a speaker box installed under the instrument main body is radiated to exterior of the instrument main body, as a leakage sound, from a through hole formed in a key bed of the instrument main body.

3. The keyboard instrument according to claim 1, wherein said rear panel serves as a reflector for acoustic waves emitted from said tone escape portion.

4. A keyboard instrument comprising a keyboard including a plurality of keys, an instrument main body having a sound generator at a rear of the keyboard, an operating panel provided at the rear of the keyboard and having operating elements for musical sound parameters setting arranged thereon, and an upper surface cover member to cover an upper portion of said instrument main body other than the keyboard and a portion of said operating panel, said keyboard instrument comprising:

tone escape portions provided in said operating panel at right and left regions separated in a direction in which the keys of said instrument main body are arranged; and a rear panel erected on an upper surface of said upper surface cover member and at a rear of said tone escape portions and having a width equal to or larger than the entire width of said keyboard in the direction in which said keys are arranged.

5. The keyboard instrument according to claim 4, wherein said tone escape portions are provided through which a sound from a speaker box installed under the instrument main body is radiated to exterior of the instrument main body, as a leakage sound, from a through hole formed in a key bed of the instrument main body.

6. The keyboard instrument according to claim 4, wherein said rear panel serves as a reflector for acoustic waves emitted from said tone escape portion.

7. A keyboard instrument comprising an instrument main body constituted of a holding portion for holding a keyboard including a plurality of keys, side panels on both sides thereof, a back panel, a key slip, and an upper surface cover member engaged with the back panel at a rear of the keyboard, said keyboard instrument comprising:

a rear panel erected on an upper surface of said upper surface cover member and having a width equal to or larger than the entire width of said keyboard in a direction in which the keys are arranged, wherein said back panel and said upper surface cover member are secured to each other via a fixing member secured to either said back panel or said upper surface cover member, and wherein a rear portion of said upper surface cover member is fixed by said fixing member and said rear panel is mounted on the upper surface of said upper surface cover member and secured to said instrument main body, whereby said upper surface cover member is held on said instrument main body.

8. A keyboard instrument comprising an instrument main body constituted of a holding portion for holding a keyboard including a plurality of keys, side panels on both sides thereof, a back panel, a key slip, and an upper surface cover member engaged with the back panel at a rear of the keyboard, said upper surface cover member being composed of a fixed portion fixed to said instrument main body and an opening/closing cover portion coupled to the fixed portion via a hinge portion to form an open state opening said keyboard and a closed state covering said keyboard, said keyboard instrument comprising:

a rear panel erected on an upper surface of said fixed portion and having a width equal to or larger than the entire width of said keyboard in a direction in which the keys are arranged; and a damper functional member for damping opening/closing of said opening/closing cover portion, wherein said damper functional member is constituted of a damper mechanism body attached to said instrument main body and a stay having one end pivotably held on said damper mechanism body and the other end pivotably held on said opening/closing cover portion at a position distanced from said hinge portion, wherein said fixed portion covers an upper portion of said instrument main body other than said keyboard, and said back panel and said upper surface cover member are secured to each other via a fixing member secured to either said back panel or said upper surface cover member, and wherein a rear portion of said fixed portion is fixed by said fixing member and said rear panel is mounted on the upper surface of said fixed portion and secured to said instrument main body, whereby said fixed portion is held on said instrument main body.

9. A keyboard instrument comprising an instrument main body having a keyboard including a plurality of keys and mounted on a key bed, a musical sound signal generating means for generating a musical sound signal by operation of the keys, a speaker for transducing the musical sound signal from said musical sound signal generating means into an acoustic sound, and an operating panel located at a rear of the keyboard, wherein a speaker box for holding said speaker is fixedly provided on a lower surface of said key bed of said instrument main body, and a through hole is provided which passes from inside said speaker box to an upper surface of said key bed, and wherein a tone escape portion is provided in said operating panel above said through hole, or a clearance for tone emission is provided between an upper portion of the rear of said keyboard and a cover of said instrument main body.

10. The keyboard instrument according to claim 9, wherein a speaker for high tones is provided on said key bed and near said through hole.

11. The keyboard instrument according to claim 9, wherein said speaker box also functions a leg supporting the instrument main body.

12. The keyboard instrument according to claim 9 wherein at least one of said tone escape portion and said clearance for tone emission is provided through which a sound from said speaker box is radiated to exterior of the instrument main body, as a leakage sound from the through hole.

* * * * *

UNITED STATES PATENT AND TRADEMARK OFFICE
Certificate

Patent No. Patent No. 7,078,611 B2 Patented: July 18, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Ryuichi Izumi, Hamamatsu (JP); Kei Kunisada, Hamamatsu (JP); Takashi Fujita, Hamamatsu (JP); and Yoshihiro Katsumata, Milton Keynes (GB).

Signed and Sealed this Twenty-first Day of October 2008.

WALTER BENSON
*Supervisory Patent Examiner*
Art Unit 2837